United States Patent [19]

Caban

[11] 3,963,385

[45] June 15, 1976

[54] VALVE ASSEMBLY FOR CONCRETE PUMPS

[76] Inventor: Angel M. Caban, 26431 Via Gorrion, Mission Viejo, Calif. 92675

[22] Filed: May 5, 1975

[21] Appl. No.: 574,298

[52] U.S. Cl. ..... 417/517; 417/519; 417/900

[51] Int. Cl.[2] ..... F04B 15/02; F04B 7/00

[58] Field of Search ..... 417/517, 519, 532, 900

[56] References Cited

UNITED STATES PATENTS

| | | | |
|---|---|---|---|
| 3,068,806 | 12/1962 | Sherrod | 417/900 |
| 3,663,129 | 5/1972 | Antosh | 417/900 |
| 3,920,357 | 11/1975 | Taylor | 417/519 |

*Primary Examiner*—William L. Freeh
*Assistant Examiner*— La Pointe

[57] ABSTRACT

An improved valve assembly providing a constant flow of semi-fluid concrete material through a concrete-pump assembly having a hopper to receive the concrete material and a plurality of hydraulically-actuated concrete pumps operably communicating with the hopper through inlet ports disposed in one wall of the hopper, the valve assembly being operably mounted within the hopper to oscillate therein. The valve comprises a main conduit for selective communication with the inlet ports, and a second conduit connected to the main conduit at one end thereof, the opposite end thereof being rotatably supported in the hopper wall and adapted to be connected to one of the hydraulic pumps. The main conduit together with the second conduit form a substantially Y-shaped configuration whereby the valve oscillates about the axis of the second conduit.

13 Claims, 8 Drawing Figures

FIG. 4.
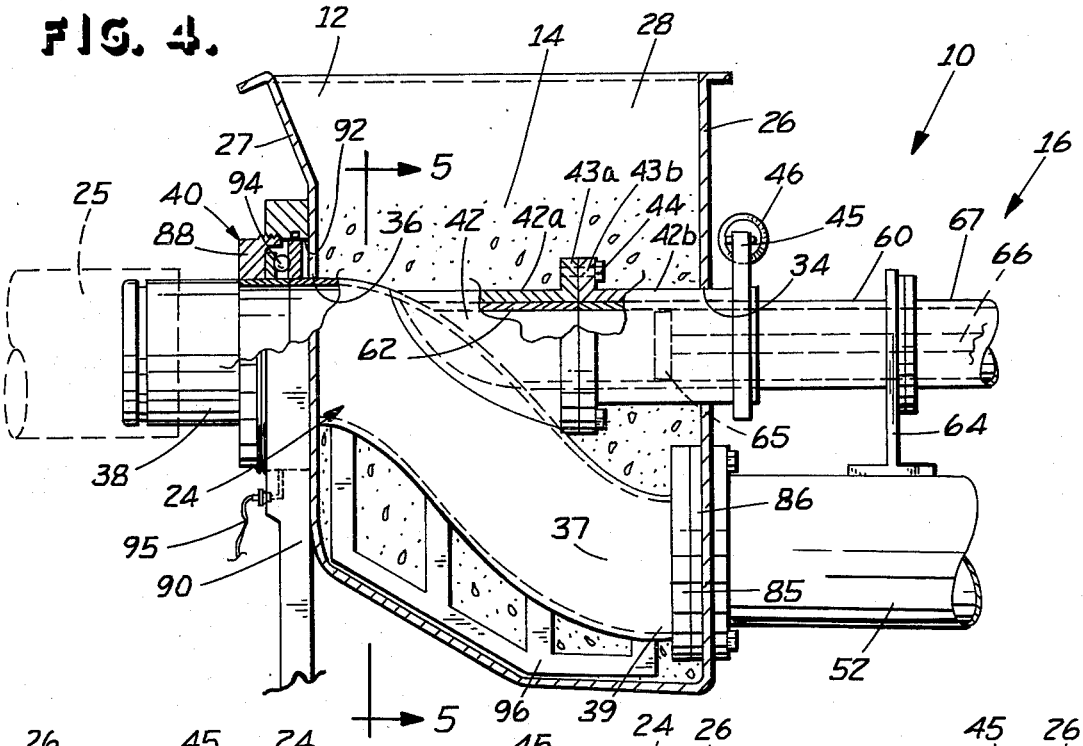
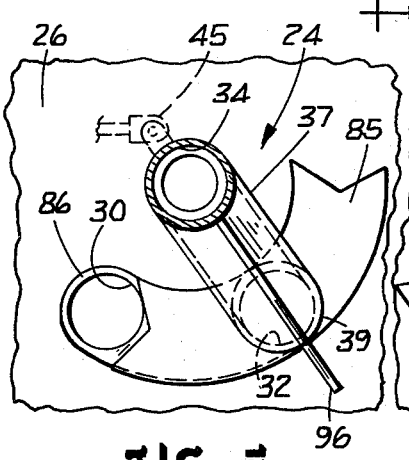
FIG. 5.
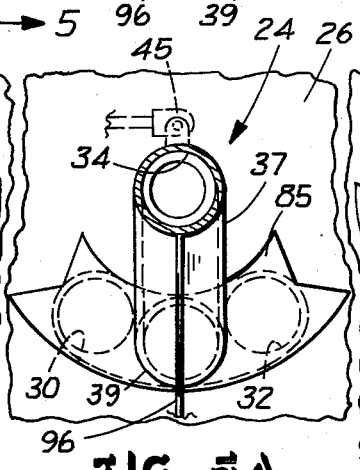
FIG. 5A.
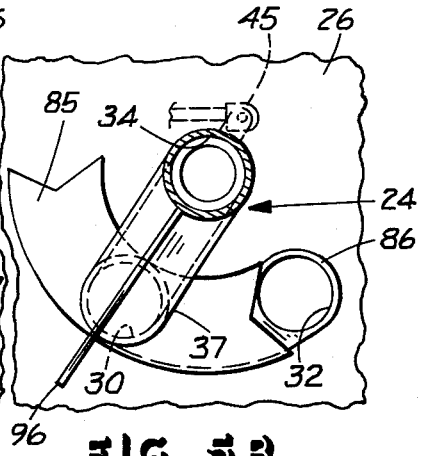
FIG. 5B.
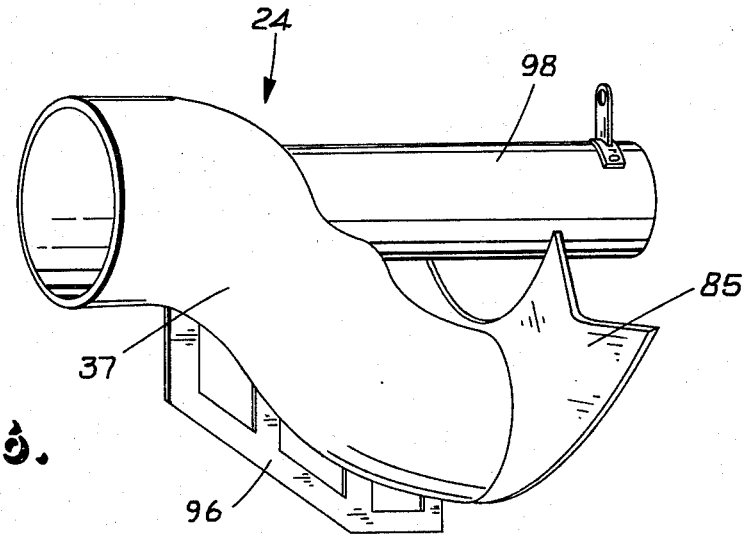
FIG. 6.

VALVE ASSEMBLY FOR CONCRETE PUMPS

BACKGROUND OF THE INVENTION

1. Field of the Invention

This invention relates to concrete-pumping machines and, more particularly, to an improved constant-flow valve assembly for concrete pumps.

2. Description of the Prior Art

At the present time, there is a great variety of concrete-pumping machines, each of these various types of machines having certain features and principles common with the others. However, all of these devices have the inherent problem of not being able to provide a constant flow of concrete.

Since the invention of concrete-pumping machines, there has been a search for low-maintenance, reliable and effective means to eliminate surge, and the accompanying jumping or shaking of the discharge hose. The continuous or constant flow of concrete has been the object of many patents issued in a field that has become crowded by attempts to arrive at some satisfactory means to accomplish that constant flow.

Oitto, U.S. Pat. No. 1,533,333, as early as 1925, discovered that alternately activated cylinders would produce a constant water flow.

Kirby, U.S. Pat. No. 2,033,338, disclosed in 1936, the use of a hydraulic cylinder to pump cement, grout or concrete, his cylinder being alternately moved between the material opening and discharge tube.

Since prior pumps became clogged in use, Logenecker, U.S. Pat. No. 2,485,208, proposed in 1949 a method introducing a water source behind the concrete-pump piston and the concrete-outlet line which could be used to clean out the apparatus.

In 1951 U.S. Pat. No. 2,548,733, disclosed a valve assemble to enable two cylinders to alternatively pump concrete, although his claims were directed to means for feeding concrete to the pump.

Pape, U.S. Pat. No. 2,690,715, in 1954 proposed a flap-and-slide valve to maintain a "pressure head" of concrete by synchronizing the discharge of two or more pumping cylinders.

More recently, Triebel, U.s. Pat. No. 2,998,781, used slide valves to alternately charge and discharge a pair of pumping cylinders; and Schwartz, U.S. Pat. No. 3,146,721, by means of his slide-valve synchronous mechanism, sought to attain constant pressure and uniform flow.

U.S. Pat. Nos. 3,198,123; 3,266,433; 3,266,435; 3,279,382 and 3,279,383 disclosed a number of different cylinder/valve combinations paired with control means of various kinds, attempting to achieve a practical constant-flow, concrete-pump mechanism.

Sherrod teaches in his patents, U.S. Pat. Nos. 3,298,322 and 3,380,3883,389,388, rotatable curved valves and improved synchronizing systems, attempting to produce a device that has truly no surge and constant flow.

Schwing, U.S. Pat. No. 3,580,696, uses a pair of flap valves to control the output of two cylinders into a single outlet and provides means to synchronize the oscillation of these valves.

Stetter, U.S. Pat. No. 3,628,897, and other use rotary valve mechanisms which are not pertinent to this discussion but are of interest in that they illustrate the various approaches used in an attempt to solve the problem inherent in a constant-pressure, continuous-flow, concrete-pumping mechanism.

Cole, U.S. Pat. No. 3,650,638, and Antosh, U.s. Pat. No. 3,663,129, introduce the concept of three or more concrete-pump cylinders synchronously operating to reduce the time interval required for the valves to operate.

Antosh has an auxiliary cylinder which enables him to maintain communication between a discharging concrete-pump assembly and the outlet duct at all times. His valve, however, is an enlarged chamber which must encompass the outlets of at least two concrete-pumping assemblies at all times. This enlarged valve in practice is a source of packing and accumulation of large aggregate, thus causing clogging of the mechanism. Flow characteristics of the concrete from the cylinder-discharge opening to the outlet duct is less than optimum because of the large-volume valve and relatively small outlet opening.

Guddal, et al., U.S. Pat. No. 3,683,575, introduces a Y-shaped fitting to control the flow of concrete through the pump from two discharge cylinders. His prior art is of interestin that he recognizes a Y-shape as being more efficient than Antosh's enlarged valve means. However, Guddal uses a slidable valve spool to connect the outflow of the cylinder to each leg of the Y, and his invention fails to achieve the constant-pressure, continuous flow for surges occuring during the interval the valve is moving from one leg of the Y to the other.

SUMMARY OF THE INVENTION

The present invention comprises an improved constant-flow valve assembly particularly designed to be incorporated within a concrete-pumping machine, whereby a constant discharge of semi-fluid concrete can be maintained throughout the operation thereof.

To accomplish a continuous flow of concrete, there is provided an oscillating-valve assembly operably mounted within the concrete hopper of the pumping machine. The hopper includes a plurality of inlet ports arcuately juxtaposed to each other and an opening disposed above and centrally positioned between the inlet ports. Each of said ports has a hydraulic-pump means mounted thereto for communication with the interior of the hopper. The opposite wall of the concrete hopper is provided with a single discharge opening through which the valve assembly is rotatably mounted.

The oscillating-valve assembly comprises a main conduit which has a discharge end and a receiving end, the discharge end being movably mounted in the discharge opening of the hopper, whereby the receiving end thereof can be selectively positioned adjacent any one of the inlet ports — thus providing a means by which concrete can flow from the hydraulic pumps to the discharge side of the hopper. A second conduit is connected at one end thereof to the main conduit, and the opposite end of the second conduit is rotatably supported through the hopper wall and adapted to be connected to an auxiliary hydraulic-pump means. Together, the main conduit and the second conduit form a substantially Y-shaped configuration whereby the valve can oscillate about the longitudinal axis of the second conduit — thus providing an alternating communication between the discharge end of the valve and the arcuately disposed inlet ports. In addition, a control means is coupled to the valve assembly to provide the acuating force whereby the valve assembly will oscillate between the inlet ports. Accordingly, as the receiving end of the main conduit alternates between each outlet port, the auxiliary hydraulic-pump means operates intermittently, causing the semi-fluid concrete to flow in a continuous manner through the discharge end of the valve assembly.

OBJECTS AND ADVANTAGES OF THE INVENTION

The present invention has for an important object to overcome the deficiencies of the prior art and produce an efficient, reliable, constant-pressure, continuous-flow, concrete-pumping system by means of a new valve mechanism.

It is another object of this invention to provide a continuous-flow valve assembly for concrete machines in which the passage from the conduit is equal to the diameter of the cylinder of the hydraulic pump where it is interconnected, and is also equal to the diameter of the outlet at the other end.

It is still a further object of this invention to provide a continuous-flow valve having a means to agitate and move the cement disposed in the bottom of the hopper, to prevent packing or hardening which would interfere with valve operation.

It is a further object of this invention to provide a valve for concrete-pumping mechanisms which has a control-valve plate to prevent back flow during the shifting mode;

A still further object of the invention is to provide a valve assembly of this character wherein an auxiliary hydraulic pump means supplies a continuous flow of semi-fluid concrete through the discharge end of the valve, thus preventing pipe line jumping and kicking from shock loads.

It is still another object of this invention to provide a continuous flow valve for concrete pumps having a relatively long working life and is simple and rugged in construction.

The characteristics and advantages of the invention are further sufficiently referred to in connection with the accompanying drawings, which represent one embodiment. After considering this example, skilled persons will understand that variations may be made without departing from the principles disclosed and I contemplate the employment of any structures, arrangements or mode of operation that are properly within the scope of the appended claims.

DESCRIPTION OF THE DRAWINGS

Referring more particularly to the accompanying drawings, which are for illustrative purposes only:

FIG. 4 is an enlarged, cross-sectional view taken substantially along line 4—4 of FIG. 1;

FIG. 5 is a diagrammatic cross-section taken along line 5—5 of FIG. 4;

FIG. 5A and 5B illustrate the various discharge positions of the valve; and FIG. 6 is a perspective view of an alternative arrangement of the valve assembly.

DESCRIPTION OF THE PREFERRED EMBODIMENT

Figure 1:
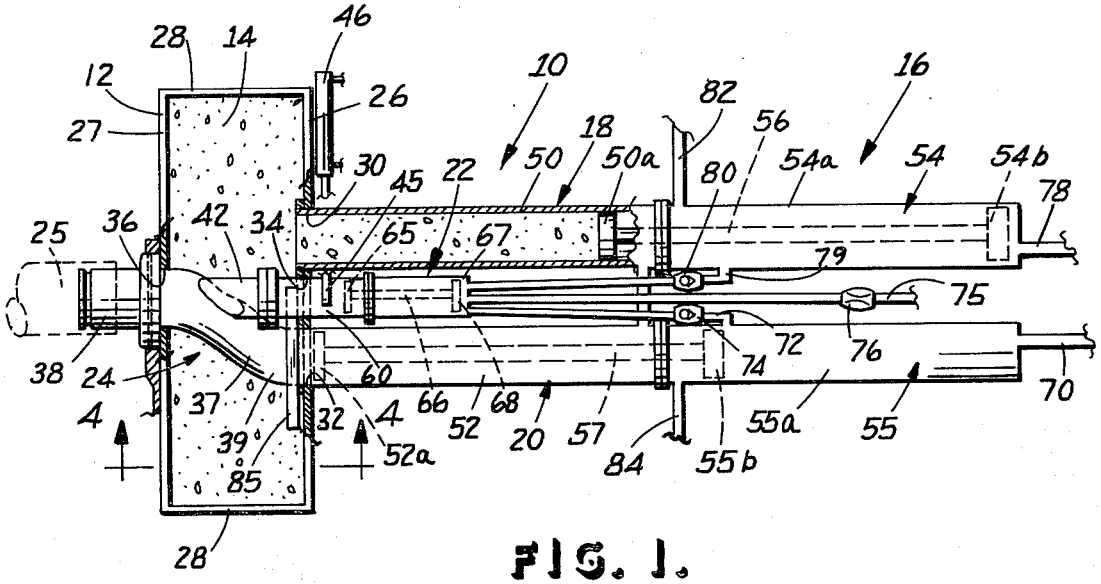
FIG. 1 is a top-plan view with a portion thereof broken away, showing the present invention provided with two main, hydraulic-cylinder, concrete pumps having an auxiliary pump positioned therebetween wherein the valve is positioned for communication from one of the pumps to the discharge duct.

Referring more particularly to the drawings, there is shown a concrete-pump machine, generally indicated at 10, which includes a concrete hopper 12. Said hopper 12 defines a reservoir that is adapted to receive a semi-fluid concrete therein, the concrete being indicated by numeral 14. As is well known in the art, the concrete is poured into the hopper 12 and is pumped therefrom by a hydraulically operated pump menas, generally indicated at 16, which includes concrete-pump assemblies 18, 20 and 22. Pump assemblies 18 and 20 communicate directly with the hopper reservoir and the third pump 22, which will hereinafter be referred to as the auxiliary concrete pump assembly, is directly connected to the oscillating-valve assembly, designated generally by numeral 24. This valve, in association with the hydraulically operated pump means, provides a continuous, uninterrupted flow of concrete material from the hopper 12 through a discharge duct or hose 25. The valve is positioned within the hopper and adapted to oscillate about an axis for sequential communication with pumps 18 and 20, which will hereinafter be described.

The hopper 12 comprises a front wall 26, a rear wall 27 and side walls 28. The front wall includes a plurality of inlet ports 30 and 32, and an opening 34. The opening 34 is centrally disposed within wall 26 so as to be positioned above and between inlet ports 30 and 32, as shown in FIGS. 5, 5A and 5B, wherein said inlet ports 30 and 32 are juxtapositioned to each other and are arranged arcuately with respect to opening 34.

Accordingly, the continuous-flow valve assembly is rotatably mounted between opening 34 of wall 26 and outlet opening 36 of the rear wall 27, as illustrated in FIG. 4. The oscillating valve assembly comprises a main conduit 37 which is provided with a discharge end 38 and a concrete-receiving end 39, wherein the discharge end 38 thereof is retatably supported in opening 36 and is provided with a bearing and sealing means, generally indicated at 40. The main conduit is defined by a tubular member, extending outwardly and downwardly from the discharge end 38, terminating at the receiving end 39 thereof which is in sliding contact with front wall 26 and is aligned with respect to both inlet ports 30 and 32. Included within the valve assembly 24 is a second conduit which will be referred to as the auxiliary conduit 42. This conduit is integrally connected to the main conduit member 37 adjacent the discharge end thereof, forming a substantially Y-shaped configuration, and is positioned to be axially aligned between opening 36 in the rear wall 27 and opening 34 in the front wall 26. Said auxiliary conduit in FIGS. 1 through 4 is shown as being comprised of two members **42*a* and 42*b* that are adapted with mating flanges 43*a* and 43*b* which are secured together by bolts 44, or any other suitable fastening means. The use of two members 42*a* and 42*b* facilitates the mounting of the valve assembly within the hopper. However, other alternative arrangements of the valve are contemplated and one alternative arrangement will be hereinafter described. Member 42***b* extends through opening 34 and is shown having a rocker arm 45 mounted thereto, with the hydraulic piston motor 46 attached to the rocker arm 45 to provide a back-and-forth, oscillating movement which, in turn, causes the valve assembly 24 to oscillate about the longitudinal axis of the auxiliary conduit 42, wherein the receiving end 39 of the main conduit 32 can be selectively positioned adjacent either inlet port 30 or 32.

Accordingly, means are provided to pump the semi-fluid concrete material from hopper 12 through the valve assembly 24 so as to be discharged through the duct or hose 25.

Figure 2:
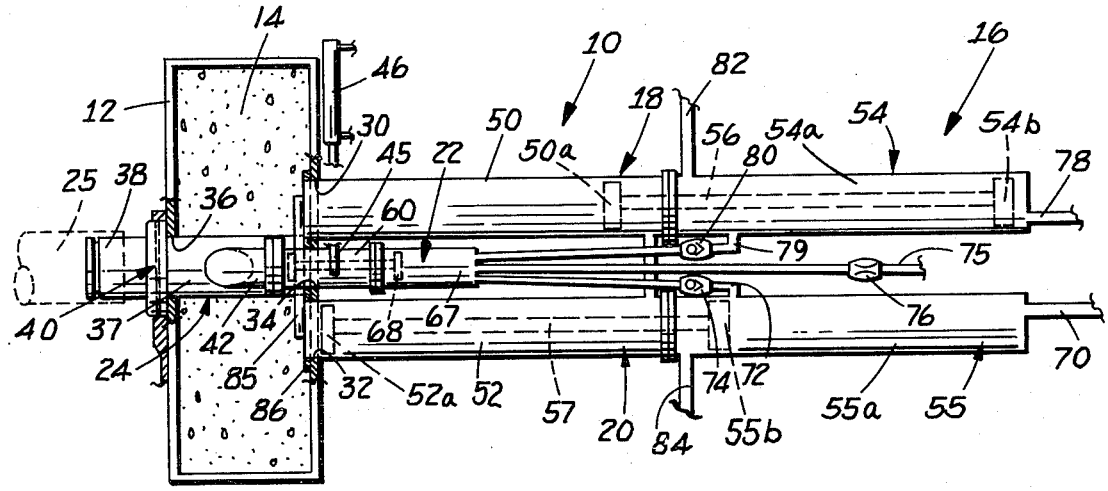
FIG. 2 is a top-plan view similar to FIG. 1, wherein the valve is in the process of shifting and the auxiliary pump is discharging.
Figure 3:
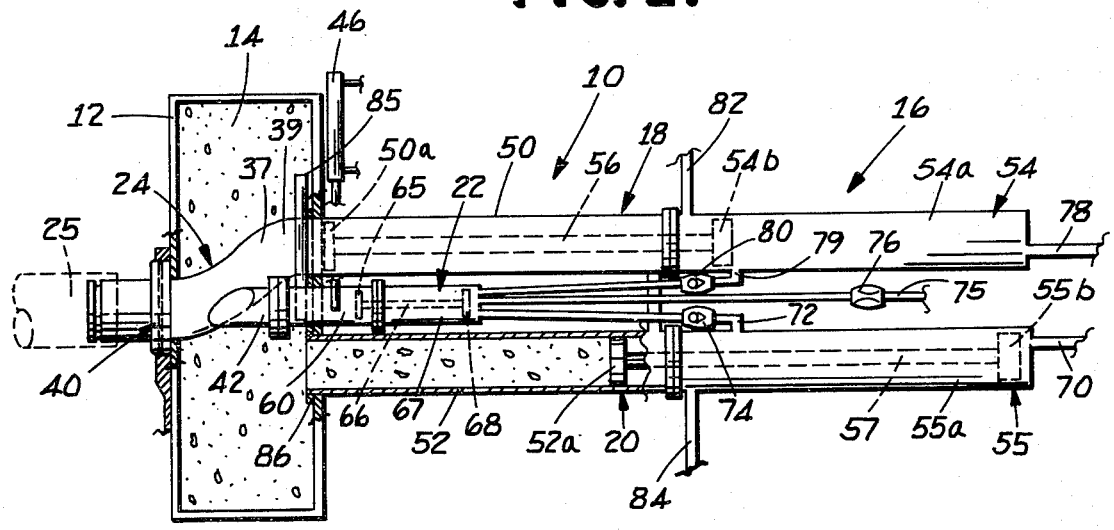
FIG. 3 is also a top plan view showing the valve in the third position wherein the third hydraulic concrete pump is allowed to discharge through the discharge duct.

Thus, the semi-fluid concrete material 14 is removed from the hopper 12 by means of the concrete-pump assemblies 18 and 20 which are connected to respective inlet ports 30 and 32, as seen in FIGS. 1 through 3, which provide communication with the interior of hopper 12 whereby the concrete 14 is drawn into the assemblies 18 and 20 for discharge through valve assembly 24. In this regard, each of the pump assemblies 18 and 20 includes concrete cylinder housings 50 and 52, and a piston 50a and 52a respectively. Cylinder housing 50 is affixed and sealed in inlet port 30, while cylinder housing 52 is affixed and sealed in inlet port 32. The pistons 50*a* and 52*a* are slidably sealed in a conventional manner within the respective cylinders 50 and 52 — thus leakage of various associated liquids and water in the concrete is restricted from flowing past pistons 50*a* and 52*a*. Means for arcuating the pumps with a reciprocating action are provided by hydraulic-piston and cylinder assemblies 54 and 55 which are operatively connected to respective pump assemblies 18 and 20. Each hydraulic assembly 54 and 55 includes a cylinder 54*a* and 55*a*, and a piston 54*b* and 55*b*, respectively. Pistons 50*a* and 52*a* are interconnected to respective pistons 54*b* and 55*b* by piston rods 56 and 57. Piston rod 56 extends between pump cylinder 50 and the hydraulic cylinder 54*a*, while piston rod 57 extends between pump cylinder 52 and the hydraulic cylinder 55*a*. The hydraulic assemblies are operably connected to any suitable conventional hydraulic system, which is well understood and thus not shown. However, various hydraulic lines are illustrated and will herein be described as to their respective functions.

In accordance with the invention, an auxiliary concrete-pump assembly 22 is provided whereby the operation thereof, in cooperation with the previously described concrete-pump assemblies 18 and 20, provides a continuous flow of concrete material to be discharged without adverse affect to the comcrete-pumping machine. The auxiliary pump assembly 22 comprises a cylinder housing 60 having a diameter so as to be received within the auxiliary conduit 42, whereby said conduit is permitted to oscillate back and forth over the cylinder housing 60 — allowing the valve assembly to freely move about the longitudinal axis of the auxiliary conduit 42. The cylinder housing 60 may extend within conduit 42 to any pre-determined distance that will not provide an obstruction to the flow of concrete through the valve; however, to obviate such a condition, a sleeve member 62 is inserted into conduit memer 42a having the same inner diameter as cylinder 60, thus clogging of the concrete is eliminated. The auxiliary concrete-pump assembly 22 is supported in place by a mounting bracket 64. A piston 65 is slidably disposed in the cylinder housing 60 and is connected to a piston rod 66 which passes through cylinder 42 into the associated hydraulic cylinder 67. A piston head 68 located in the hydraulic cylinder 67 is connected to the opposite end of rod 66. Thus, any movement of piston 68 will, in turn, move piston 65 in housing 60.

OPERATION

Hopper 12 is, as previously mentioned, kept continuously supplied with semi-fluid concrete material 14; and the level therein must be maintained above the inlet ports 30 and 32. When the concrete-pumping maching is put into operation, the hydraulic system sequentially operates each hydraulically operated pump means. Referring to FIG. 1, conduit 37 of the valve assembly 24 is shown positioned over inlet port 32 — thus providing communicating relationship with each other. Said piston head 52*a* is indicated as being fully extended; and piston 50*a* is shown fully retracted within the cylinder 50 and having concrete 14 disposed therein. As piston head 52*a* reaches its full outward stroke by means of the hydraulic force applied to hydraulic-piston head 55*b*, said force being provided through hydraulic inlet line 70. The hydraulic force is subsequently allowed to flow through outlet line 72 into hydraylic cylinder 67 of the auxiliary pump assembly 22, forcing said concrete disposed in said cylinder 60 to be discharged into said assembly 24 through conduit 42 — thus providing continuous flow through the discharge end 38. As this action takes place, valve assembly 24 is rotating from inlet port 32 to inlet port 30, as shown in FIGS. 5, 5a and 5b. It is generally at the intermediate point, as shown in FIG. 5a where the receiving end 39 is located between the inlet 30 and 32, that a pause in the flow of concrete might occur. However, the auxiliary pump prevents any lag or pause to occur during the transition between inlet ports.

Hydraulic line 72 is provided with a one-way check valve 74 whereby pressure in line 72 is not allowed to return therethrough. After piston 65 reaches its full stroke, the pressure against piston head 68 is released through return line 75 which includes a valve restrictor 76, said valve being adjusted to allow the back pressure within the valve assembly 24 to force the piston heads 65 and 68 back at a given rate, at which time the cylinder 60 is again loaded with another concrete charge, and the hydraulic pressure is then shifted to the pump assembly 18. That is, hydraulic pressure enters by hydraulic cylinder 54*a* through line 78, moving piston 54*b* and 50*a* inwardly together and forcing the concrete in cylinder housing 50 to be dicharged into valve assembly 24 by way of conduit 37, as shown in FIGS. 3 and 5*b*. Again at the end of the stroke of piston 50*a*, hydraulic pressure is allowed to be transferred to the auxiliary unit 22 through line 79, which also includes a check valve 80 to prevent bck pressure from reentering cylinder 54*a*. At the instant the auxiliary pump 22 discharges, either hydraulic pump 18 or 20 — depending on its sequential position — is forced to charge-by hydraulic pressure shifting to either inlet lines 82 or 84, wherein pressure is supplied to the opposite side of piston 54*b* or 55*b*.

In more simple terms, concrete pump 20 discharges while concrete pump 18 recharges; and, during the shifting of charging and discharging of the pumps 18 and 20, the auxiliary pump charges and discharges, overlapping the sequential operations of pump 18 and 20 — thus at no time is the flow of the semi-fluid concrete material 14 allowed to pause during the pumping operation of the machine 10.

In addition, means 40 is for maintaining a constant sealing pressure between the receiving end 39 of the valve assembly 24 and the inlet ports 30 and 32. This is accomplished by providing the receiving end 39 with a pressure plate 85 which extends laterally outward from both sides of conduit 37, slidably mating with a stationary pressure plate 86 secured to front wall 26 of hopper 12. These pressure plates 85 and 86 are held in slidable engagement by a pressure-sealing ring 88 which is adjustably received in a rearsupporting bracket 90 having an enlarged bore 92. A sealed bearing 94 is affixed to the discharge end of conduit 37 and is disposed and sealed eithin bore 92. By adjusting sealing ring 88, force is applied to the valve assembly, creating a firm contact between plates 85 and 86. However, if additional pressure is required, hydraulic force can be applied through inlet line 95 to the back side of the bearing 94, again forcing conduit 37 forward.

Pressure plate 85 is so arranged as to prevent back flow from occurring during a non-discharge mode of operation from either inlet port 30 and 32. That is, the plate 85 completely covers both openings at the same time during the discharge sequence of the auxiliary pump 22. This position is illustrated in FIG. 5A.

In order to prevent the concrete mixture in the lower area of hopper 12 from packing or hardening during the operation of the valve assembly 24, which would interfere with the valve operation thereof, an agitating means is included. This agitating means can be of various designs and is herein shown as a mixing blade 96 secured to the lower portion of conduit 37 whereby the blade moves therewith in a back-and-forth manner as said valve assembly ocsillates.

Referring to FIG. 6, there is shown an alternative arrangement of the valve assembly having an auxiliary conduit 98 formed as a single member rather than in two parts, as previously indicated.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely by way of example, and I do not wish to be restricted to the specific form shown or uses mentioned, except as defined in the accompanying claims.

I claim:

1. A constant, uniform-pressure-discharge, concrete-pump apparatus comprising:

a hopper for receiving a semi-fluid concrete mixture therein, said hopper being defined by a front wall having a centrally disposed opening and a plurality of inlet ports arcuately arranged about said central opening, and a rear wall having an outlet opening oppositely disposed and axially aligned with said central opening and side walls integrally formed therewith;

a valve assembly operably positioned within said hopper, said valve having a main conduit adapted with a receiving end and a discharge end, said discharge end being rotatably supported within said outlet opening in said rear wall, said receiving end thereof being movably positioned adjacent each inlet port during rotation thereof, and an auxiliary conduit integrally connected to said main conduit adjacent the discharge end thereof, the opposite end of said auxiliary conduit being rotatably supported in said central opening in said front wall, whereby said conduits form a substantially Y-shaped configuration;

a plurality of concrete-pump assemblies connected to each of said inlet ports for communication with the interior of said hopper, whereby said concrete is sequentially pumped from said hopper through said main conduit of said valve for discharge therefrom; and an auxiliary concrete-pump assembly connected to said auxiliary conduit for operable communication with said concrete disposed in said valve assembly, whereby said auxiliary-pump assembly is operably synchronized with said other concrete pump assemblies to provide a continuous, uninterrupted flow of concrete from the discharge end of said valve assembly.

2. A concrete-pump apparatus as recited in claim 1, wherein a pair of inlet ports are arcuately positioned below said central opening adjacent the lower portion of said hopper, and wherein each of said inlet ports has a diameter equal to the diameter of said main conduit, and means attached to the valve assembly to provide an oscillating movement between each of said inlet ports.

3. A concrete-pump apparatus as recited in claim 2, wherein said apparatus includes means for sequentially operating said concrete-pump assemblies and said auxiliary pump assembly in a synchronized manner.

4. A concrete-pump apparatus as recited in claim 3, wherein each of said concrete pump assemblies comprises:

a cylinder housing secured to each of said inlet ports for receiving and discharging concrete therein;

a piston slidably disposed within said housing; and means secured to said piston to provide reciprocating movement thereto.

5. A concrete-pump apparatus as recited in claim 4, wherein said auxiliary pump comprises:

a cylinder housing for receiving concrete therein operably connected to said auxiliary conduit;

a piston slidably disposed within said housing; and means secured to said piston to provide reciprocating movement thereto.

6. A concrete-pump apparatus as recited in claim 5, wherein said cylinder housings secured to said inlet ports include a diameter equal to the diameter of said main conduit, whereby back pressure is eliminated therein; and wherein the diameter of said auxiliary cylinder housomg connected to said auxiliary conduit is provided with a diameter equal to said diameter of said auxiliary conduit.

7. A concrete-pump apparatus as recited in claim 6, wherein said auxiliary conduit of said valve assembly has a reduced diameter to that of said main conduit.

8. A concrete-pump apparatus as recited in claim 7, wherein the space interposed between each of said inlet ports is equal to the diameter of said inlet ports.

9. A concrete-pump aparatus as recited in claim 8, wherein said valve assembly rotates about the axis of said auxiliary conduit.

10. A concrete-pump apparatus as recited in claim 9, wherein said apparatus includes means for maintaining constant sealing pressure between said receiving end of said main conduit and said outlet ports.

11. A concrete pump apparatus as recited in claim 10, wherein said constant-sealing-pressure means comprises an arcuate plate secured adjacent the receiving end of said main conduit for slidable engagement with said outlet ports, wherein at least one outlet port is closed at all times to prevent back pressure therethrough.

12. A concrete-pump apparatus as recited in claim 11, wherein said apparatus includes a bearing means affixed to said discharge end of said main conduit.

13. A concrete-pump apparatus as recited in claim 3, wherein said apparatus includes an agitating means secured to said valve assembly, whereby the concrete is agitated while being pumped from said hopper.

* * * * *